US007878419B2

(12) United States Patent
Waddelow

(10) Patent No.: US 7,878,419 B2
(45) Date of Patent: Feb. 1, 2011

(54) SPRAY HEAD WITH COVERS

(75) Inventor: Simon J. Waddelow, Ely (GB)

(73) Assignee: Sta-Rite Industries, LLC, Delavan, WI (US)

( * ) Notice: Subject to any disclaimer, the term of this patent is extended or adjusted under 35 U.S.C. 154(b) by 462 days.

(21) Appl. No.: 11/901,970

(22) Filed: Sep. 19, 2007

(65) Prior Publication Data

US 2008/0083838 A1 Apr. 10, 2008

Related U.S. Application Data

(60) Provisional application No. 60/845,843, filed on Sep. 19, 2006.

(51) Int. Cl.

| | |
|---|---|
| ***B05B 1/14*** | (2006.01) |
| ***B05B 1/34*** | (2006.01) |
| ***B05B 15/02*** | (2006.01) |
| ***B05B 1/02*** | (2006.01) |
| *A62C 31/05* | (2006.01) |
| *A62C 37/08* | (2006.01) |

(52) U.S. Cl. ..... 239/104; 239/288.5; 239/463; 239/548; 239/553; 169/37; 169/57

(58) Field of Classification Search ..... 239/104, 239/288–288.5, 461, 559, 567, 600, 463, 239/487, 488, 548, 550, 552, 553; 169/37, 169/57, 65

See application file for complete search history.

(56) References Cited

U.S. PATENT DOCUMENTS

| | | | | |
|---|---|---|---|---|
| 4,213,567 | A | | 7/1980 | McIntire |
| 4,989,675 | A | | 2/1991 | Papavergos |
| 5,031,701 | A | | 7/1991 | McLelland et al. |
| 5,199,500 | A | | 4/1993 | Norman et al. |
| 5,392,993 | A | | 2/1995 | Fischer |
| 5,433,383 | A | | 7/1995 | Sundholm |
| 5,501,282 | A | * | 3/1996 | Sundholm ..... 169/37 |
| 5,505,383 | A | | 4/1996 | Fischer |
| 5,513,708 | A | | 5/1996 | Sundholm |
| 5,573,065 | A | | 11/1996 | Sundholm |
| 5,622,225 | A | | 4/1997 | Sundholm |
| 5,639,029 | A | | 6/1997 | Sundholm |
| 5,655,608 | A | | 8/1997 | Sundholm |
| 5,667,017 | A | | 9/1997 | Hoffmann et al. |
| 5,769,327 | A | | 6/1998 | Kure et al. |

(Continued)

FOREIGN PATENT DOCUMENTS

| | | |
|---|---|---|
| DE | 10349760 | 6/2005 |

(Continued)

*Primary Examiner*—Darren W Gorman
(74) *Attorney, Agent, or Firm*—Greenberg Traurig, LLP

(57) ABSTRACT

Embodiments of the invention provide a spray head including a housing having a facetted front face with a plurality of intersecting surfaces. The spray head can include a nozzle in each one of the plurality of intersecting surfaces. The nozzle can be positioned within a first recess of the housing so that an outer end of the nozzle does not extend past an outer surface of the housing. The nozzle can generate and dispense a fog-like mist. The spray head can include a cover that substantially prevents an orifice of the nozzle from becoming blocked with debris. The cover can be installed within a second recess of the nozzle so that the cover is substantially flush with the outer surface of the housing.

12 Claims, 5 Drawing Sheets

U.S. PATENT DOCUMENTS

| | | | | |
|---|---|---|---|---|
| 5,794,705 | A | 8/1998 | Kim et al. | |
| 5,944,113 | A | 8/1999 | Sundholm | |
| 5,967,237 | A | 10/1999 | Sundholm | |
| 5,967,239 | A | 10/1999 | Sprakel et al. | |
| 6,112,820 | A | 9/2000 | Job et al. | |
| 6,129,154 | A | 10/2000 | Hoffmann et al. | |
| 6,158,522 | A | 12/2000 | Laderoute | |
| D438,933 | S | 3/2001 | Sundholm | |
| D445,164 | S | 7/2001 | Adams | |
| 6,279,663 | B1 | 8/2001 | Sundholm | |
| 6,296,062 | B1 | 10/2001 | Sundholm | |
| 6,305,620 | B1 | 10/2001 | Marchese | |
| 6,315,219 | B1 * | 11/2001 | Palestrant | 239/550 |
| 6,318,474 | B1 | 11/2001 | Sundholm | |
| 6,345,670 | B1 | 2/2002 | Sundholm | |
| 6,371,212 | B1 | 4/2002 | Jackson | |
| 6,394,366 | B1 | 5/2002 | Adams | |
| D462,109 | S | 8/2002 | Adams | |
| 6,454,017 | B1 | 9/2002 | Fischer et al. | |
| 6,536,534 | B1 | 3/2003 | Sundholm | |
| 6,578,877 | B1 | 6/2003 | Sundholm | |
| 6,732,808 | B1 | 5/2004 | Sprakel | |
| 6,745,847 | B2 | 6/2004 | Kim | |
| 6,948,566 | B2 | 9/2005 | Sundholm | |
| 6,976,544 | B2 | 12/2005 | Sundholm | |
| 7,032,681 | B1 | 4/2006 | Sprakel | |
| 7,096,829 | B2 | 8/2006 | Mahlanen et al. | |
| 7,185,829 | B2 | 3/2007 | Sundholm | |
| 7,395,868 | B2 | 7/2008 | Sundholm | |
| 2003/0150624 | A1 | 8/2003 | Rummel | |
| 2005/0011652 | A1 | 1/2005 | Hua | |
| 2006/0097069 | A1 | 5/2006 | Sundholm | |

FOREIGN PATENT DOCUMENTS

| | | |
|---|---|---|
| EP | 0927562 | 7/1999 |
| EP | 0933097 | 8/1999 |
| GB | 560970 | 4/1944 |
| GB | 629335 | 9/1949 |
| GB | 629365 | 9/1949 |
| GB | 632713 | 12/1949 |
| GB | 743105 | 1/1956 |
| GB | 748042 | 4/1956 |
| GB | 1379205 | 1/1975 |
| GB | 2417699 | 3/2006 |
| JP | 9122537 | 5/1997 |
| JP | 2002017883 | 1/2002 |
| JP | 2003284788 | 10/2003 |
| WO | WO94/25112 | 10/1994 |
| WO | WO96/01666 | 1/1996 |
| WO | WO97/43046 | 11/1997 |
| WO | WO00/15303 | 9/1999 |
| WO | WO02/00302 | 1/2002 |
| WO | WO2007/113483 | 10/2007 |
| WO | WO2009/118513 | 10/2009 |

* cited by examiner

SPRAY HEAD WITH COVERS

RELATED APPLICATIONS

This application claims priority to U.S. Provisional Application No. 60/845,843, filed Sep. 19, 2006, the entire content of which is incorporated herein by reference.

BACKGROUND OF THE INVENTION

Spray heads with one or more nozzles are often used to dispense water or other fire extinguishing material in order to suppress a fire. Some spray heads or nozzles, however, can dispense too much fire extinguishing material or an inappropriate amount of fire extinguishing material and can cause damage, such as water damage, to the object on fire and the surrounding area. Over-applying a fire extinguishing material can also quickly deplete the supply of the fire extinguishing material available to the spray head, which can impact the performance of the spray head and other spray heads receiving fire extinguishing material from the same supply.

The type of fire extinguishing material dispensed by a spray head can also cause problems. For example, if a spray head dispenses an inert gas, such as nitrogen, the gas can present health risks, such as suffocation, to living beings exposed to the gas.

In many situations, spray heads are placed in environments where they can be exposed to dust or debris that can prevent the spray heads from working properly. Covers installed over the spray head can help reduce the dust or debris that the spray head is exposed to. For example, some spray heads include a press-fit cover. The press-fit cover, however, can easily fall out when the cover is exposed to a range of temperatures that causes the cover to expand and contract.

SUMMARY OF THE INVENTION

Embodiments of the invention provide a spray head. The spray head can include a housing having a facetted front face including a plurality of intersecting surfaces. The spray head can include one or more nozzles in each one of the plurality of intersecting surfaces. The nozzle can be positioned within a first recess of the housing so that an outer end of the nozzle does not extend past an outer surface of the housing. The nozzle can generate and dispense a fog-like mist. The spray head can include a cover that substantially prevents an orifice of the nozzle from becoming blocked with debris. The cover can be installed within a second recess of the nozzle so that the cover is substantially flush with the outer surface of the housing.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings.

Figure 2:
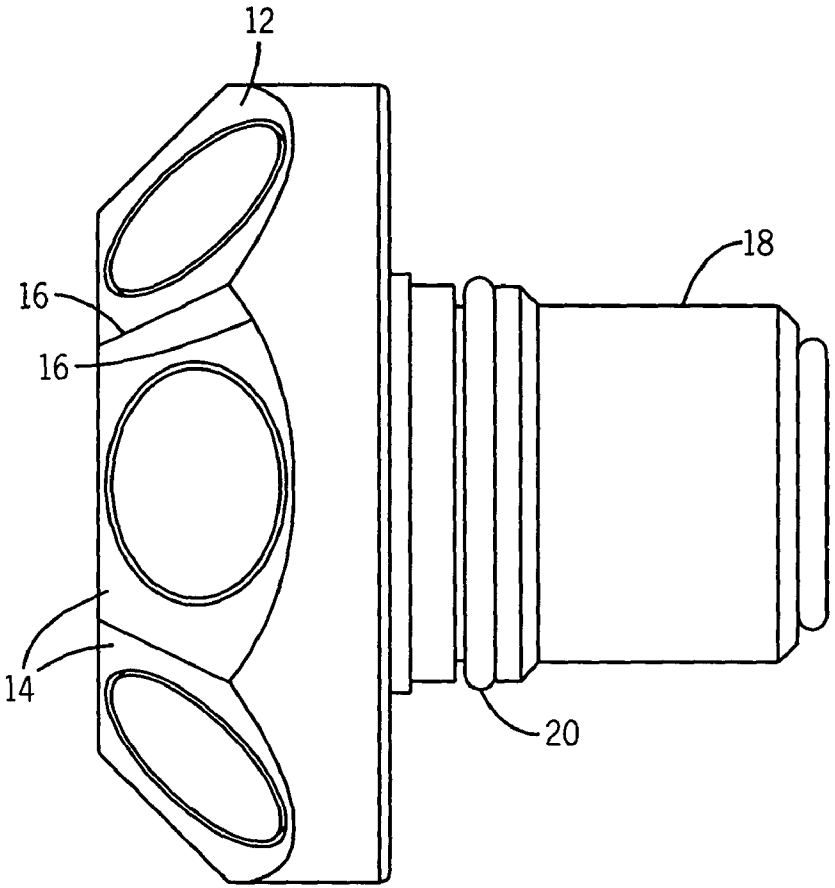
FIG. 2 is a side view of the spray head of FIG. 1
Figure 1:
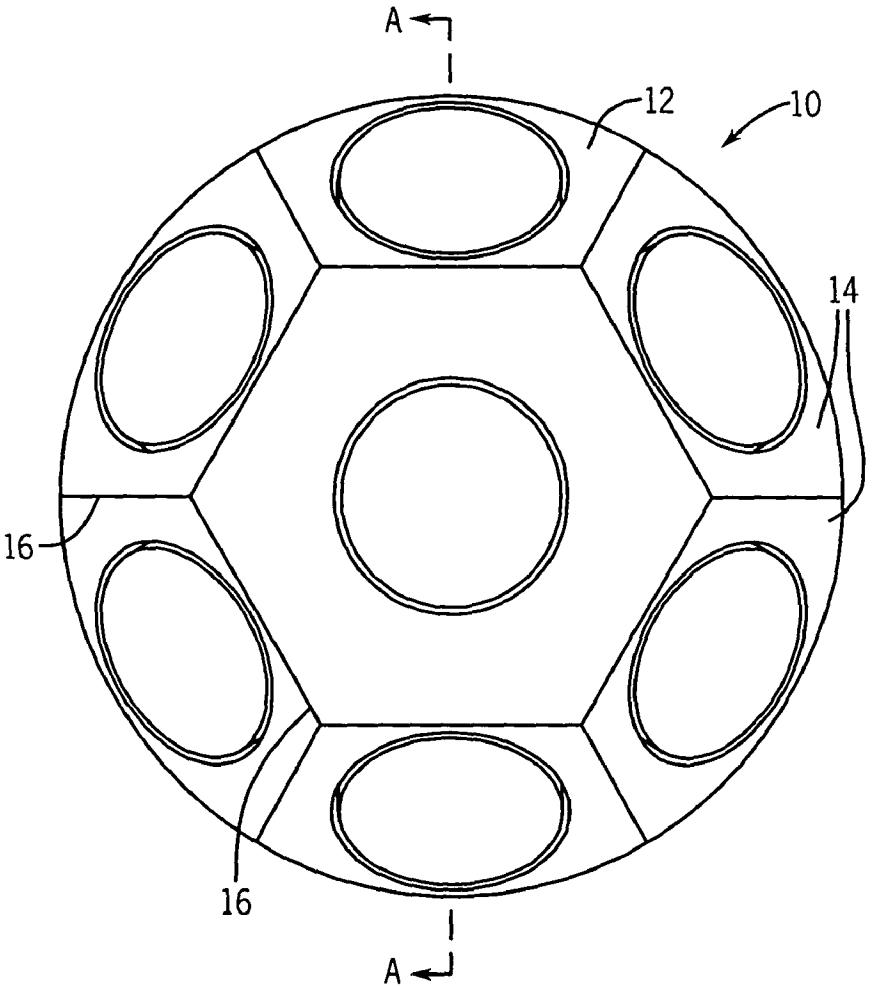
FIG. 1 is a front view of a spray head according to one embodiment of the invention.

FIGS. 1 and 2 illustrate a spray head according to one embodiment of the invention. As shown in FIGS. 1 and 2, the spray head 10 can include a housing 12 with a facetted front face 14. The facetted front face 14 can include a plurality of intersecting surfaces 16. In some embodiments, the facetted front face 14 can provide a surface that is easy to clean since all of the surfaces are relatively flat. The facetted front face 14 can also give the spray head 10 an aesthetically pleasing look.

As shown in FIG. 2, the spray head 10 can include a threaded end 18 that interfaces with a fire extinguishing material supply conduit (not shown). The spray head 10 can also include an o-ring 20 or other sealing mechanism that can prevent fire extinguishing materials from leaking between the threaded end 18 and the conduit.

Figure 3:
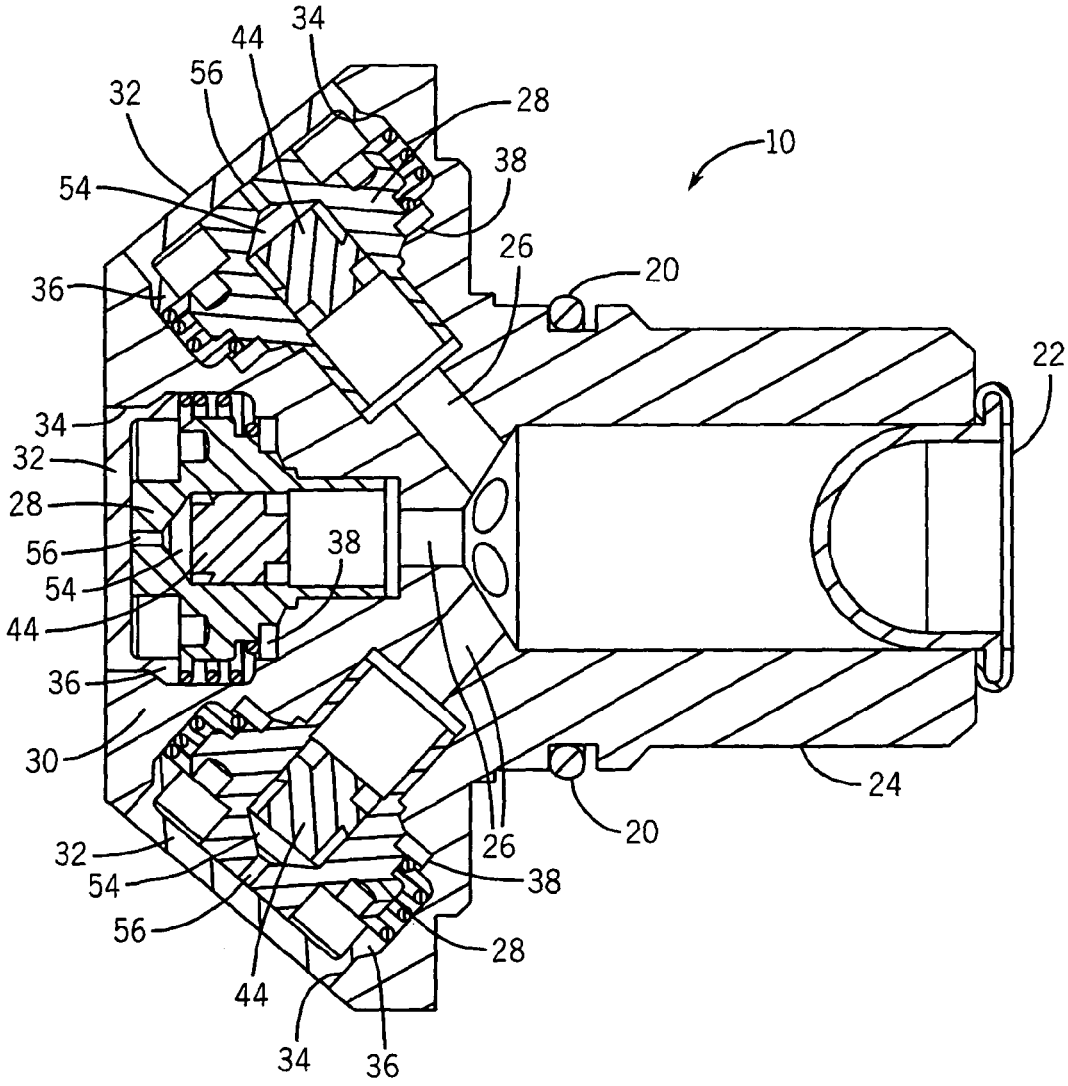
FIG. 3 is a cross-sectional view of the spray head taken along line A-A of FIG. 1.

As shown in FIG. 3, the spray head 10 can include a strainer 22 that filters fire extinguishing material entering the spray head 10 (e.g., from the fire extinguishing material supply conduit.) Filtered water can flow into a fogging head body 24 of the spray head 10. The fogging head body 24 of the spray head 10 can include a plurality of channels 26 leading to a plurality of nozzles 28.

As shown in FIGS. 1-3, each intersecting surface 16 of the facetted front face 14 can include an individual nozzle 28 that is installed into a recess 34 of a main body 30 of the spray head. The individual nozzles 28 can be angled to spray fire extinguishing material (e.g., water) at optimum angles. In some embodiments, the individual nozzles 28 of the spray head 10 can be configured to provide particular flow-rates and spray cone angles in order to suit different applications. The number of channels 26 and nozzles 28 included in the spray head 10 can also be varied in order to suit a given application.

In some embodiments, the nozzles 28 can generate a fog-like mist (e.g., of water) that can fill a space in order to suppress a fire. By generating a mist rather than a straight flow of fire extinguishing material, the nozzles 28 can conserve fire extinguishing material and can limit damage (e.g., water damage) to the objects on fire and the surrounding area. In addition, the mist generated by the nozzles 28 can act as a scrubbing agent that can help remove damaging smoke from the air.

As shown in FIGS. 1-3, each of the nozzles 28 can include an energized cover 32. The nozzle 28 and the cover 32 can be positioned within a recess 34 of the facetted front face 14. The cover 32 can prevent debris (e.g., cooking grease) from blocking or clogging an orifice of a nozzle 28. In some embodiments, when the cover 32 is installed, the cover 32 can be generally flush with the facetted front face 14. The flush surfaces can provide an easy cleaning surface.

To hold each cover 32 over each nozzle 28, the nozzle 28, or the recess 34 that the nozzle 28 is positioned within, can include an energizing ring 36 and a gasket 38. In one embodiment, the gasket 38 can be constructed of copper. In one embodiment, the main body 30 is constructed of stainless steel and the cover 32 is constructed of polytetrafluoroethylene (PTFE). PTFE has a higher thermal expansion rate than that of stainless steel. In another embodiment, the cover 32 is constructed of PTFE combined with a metallic filler (e.g., about 50% PTFE and about 50% stainless steel). The metallic filler can allow the cover 32 to be detected by metal detecting equipment, for example in food processing lines. The cover 32 can be press-fitted into the bore or recess 34 in which it sits. This can provide sealed resistance against release or blowing out until a set level of water pressure is reached. However, PTFE has very little elastic recovery. As the PTFE cover 32 expands/contracts in relation to the stainless steel bore or recess 34 with temperature changes, the energizing ring 36 maintains a substantially constant mechanically-induced side wall pressure to keep the cover 32 sealed in place.

Figure 4:
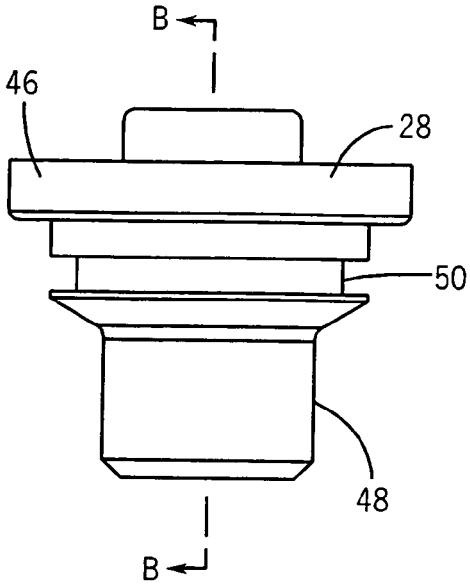
FIG. 4 is a side view of a nozzle according to one embodiment of the invention.
Figure 5:
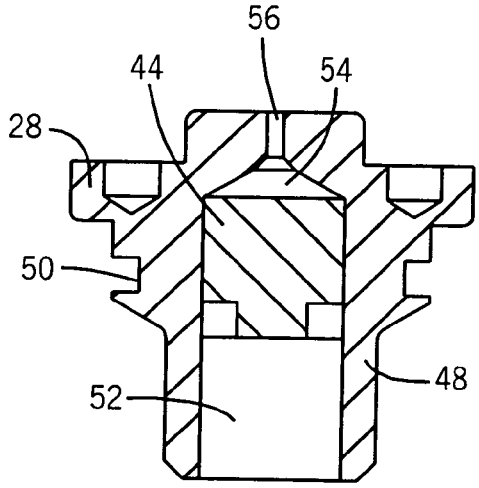
FIG. 5 is a cross-sectional view of the nozzle taken along line B-B of FIG. 4.
Figure 6:
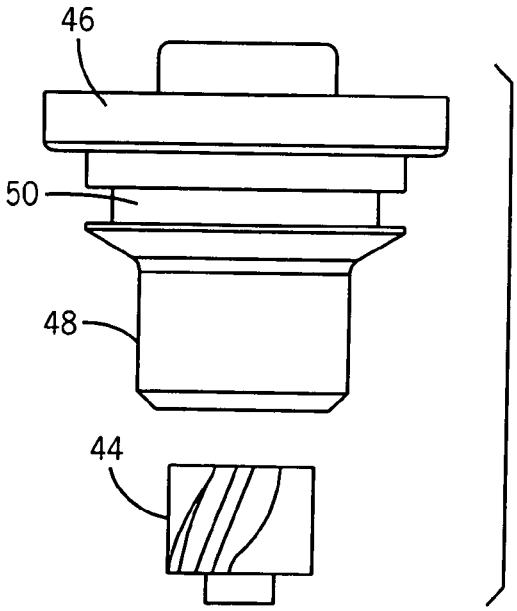
FIG. 6 is an exploded view of the nozzle of FIG. 4.

As shown in FIG. 3, each nozzle 28 can also include an o-ring 42 or other sealing mechanism that can prevent fire extinguishing liquid from leaking between the nozzle 28 and the recess 34 that the nozzle 28 is positioned within. As shown in FIG. 4, the nozzle 28 can include a nozzle body 46 with a threaded portion 48 that is received adjacent to the channel 26 (as shown in FIG. 3). The nozzle body 46 can also include a seat 50 to receive the o-ring 42. The nozzle body 46 can include a chamber 52 upstream of a swirl insert 44, which can generate the fog-like mist. The nozzle body 46 can include a chamber 54 downstream of the swirl insert 44, and a discharge orifice 56 downstream of the chamber 54.

Figure 7:
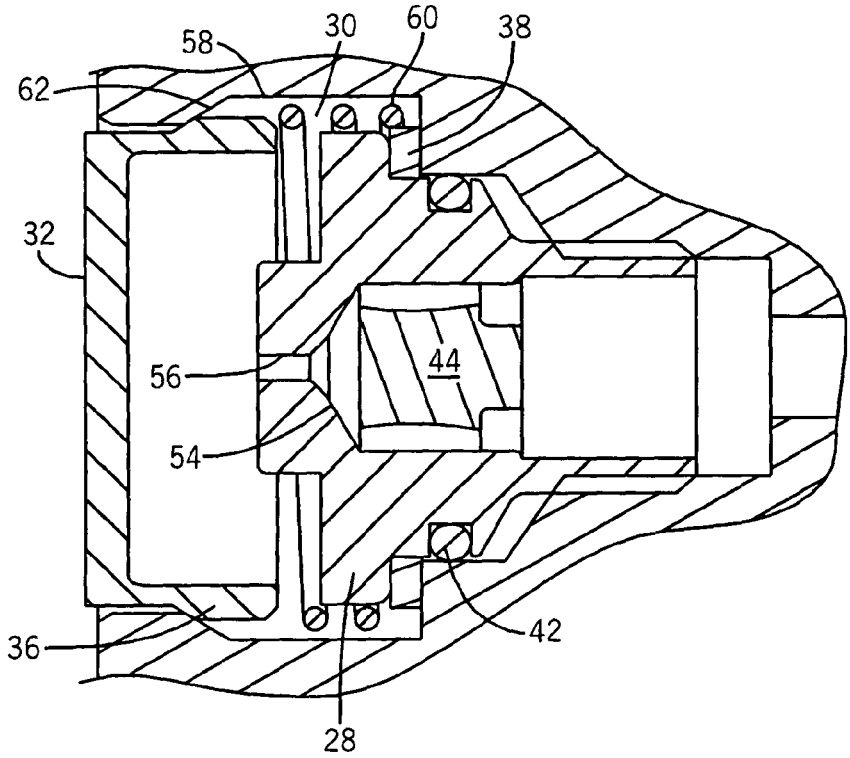
FIG. 7 is a cross-sectional view of a nozzle at room temperature according to another embodiment of the invention.
Figure 8:
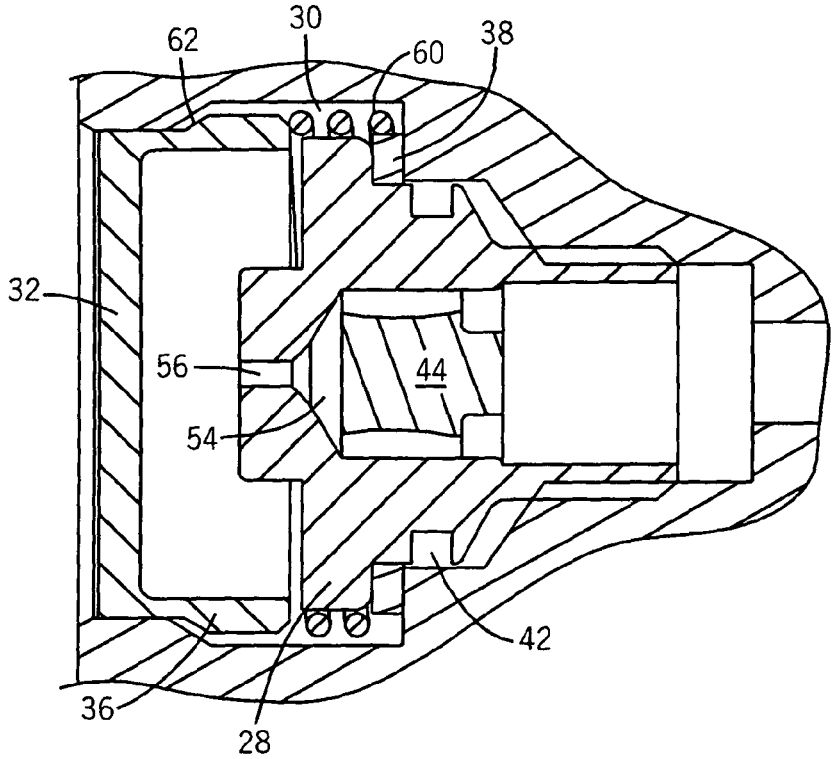
FIG. 8 is a cross-sectional view of the nozzle of FIG. 7 at a maximum service temperature.
Figure 9:
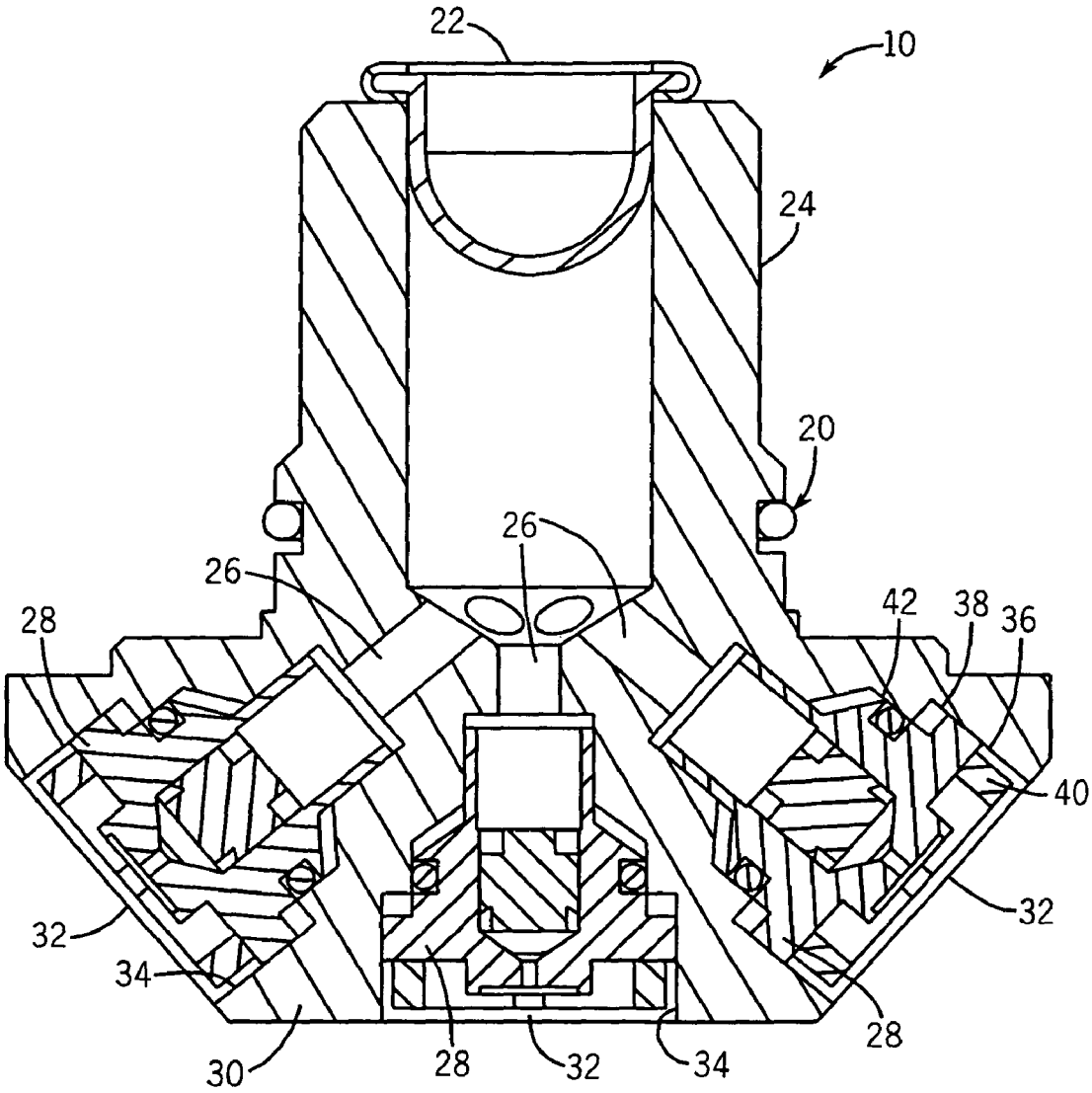
FIG. 9 is a cross-sectional view of a spray head including the nozzles of the embodiment of FIGS. 7 and 8.

FIGS. 7 and 8 illustrate an alternative embodiment of a nozzle 28 of spray head 10. The cover 32 can be press-fitted into an undercut 58 in the main body 30. A spring 60 between the main body 30 and the cover 32 can help ensure that a seal is made between tapered joining faces 62. As the spray head 10 increases from room temperature (about 20 degrees Celsius, as shown in FIG. 7) to a maximum service temperature (about 300 degrees Celsius, as shown in FIG. 8), the cover 32 can expand in relation to the stainless steel bore or recess 34, but the spring 60 can allow the cover 32 to slide down the tapered joining face 62. This can help prevent the PTFE cover 32 from being compressed beyond its elastic limit at elevated temperatures. If this were to occur, the diameter of the cover 32 would at room temperature no longer be sufficient to keep the cover 32 retained in the main body 30. The cover 32 can substantially prevent the nozzle discharge orifice 56 from blockage while not in use. Once a fire protection system is activated and the spray head 10 achieves a sufficient level of water pressure, the cover 32 can be blown out of the stainless steel bore or recess 34 and the fog-like mist can be free to form. FIG. 9 illustrates a nozzle body 10 including the embodiment of the nozzles 28 of FIGS. 7 and 8. FIG. 9 illustrates an energizing ring 40 and an o-ring 42 included in the nozzles 28.

Various features and advantages of the invention are set forth in the following claims.

The invention claimed is:

1. A spray head comprising:

a housing having a facetted front face including a plurality of intersecting surfaces;

a plurality of nozzles, one of the plurality of nozzles included in each one of the plurality of intersecting surfaces, the one of the plurality of nozzles being positioned within a first recess of the housing so that an outer end of the one of the plurality of nozzles does not extend past an outer surface of the housing, each one of the plurality of nozzles generating and dispensing a fog-like mist; and a cover that substantially prevents a discharge orifice of each one of the plurality of nozzles from becoming blocked with debris, the cover installed within a second recess of each one of the plurality of nozzles so that the cover is substantially flush with the outer surface of the housing.

2. The spray head of claim 1 and further comprising a fogging head body with a plurality of channels, each one of the plurality of channels leading to nail one of the plurality of nozzles.

3. The spray head of claim 1 and further comprising a strainer to filter liquid entering the spray head.

4. The spray head of claim 1 wherein the housing is constructed of stainless steel and the cover is constructed of polytetrafluoroethylene.

5. The spray head of claim 1 wherein the cover is constructed of polytetrafluoroethylene and stainless steel.

6. The spray head of claim 1 wherein the cover is press-fit in the second recess to provide sealed resistance against release until a set level of water pressure is reached.

7. The spray head of claim 1 wherein each one of the plurality of nozzles includes at least one of an energizing ring, a gasket, and an o-ring.

8. The spray head of claim 7 wherein the gasket is constructed of, copper.

9. The spray head of claim 1 wherein each one of the plurality of nozzles includes a nozzle body, the nozzle body includes a first chamber, and the first chamber is positioned upstream of a swirl insert that generates the fog-like mist.

10. The spray head of claim 9 wherein each one of the plurality of nozzles includes a second chamber downstream of the swirl insert and the discharge orifice which is downstream of the second chamber.

11. The spray head of claim 1 wherein the first recess includes an undercut, tapered joining faces, and a spring positioned between the housing and the cover.

12. The spray head of claim 11 wherein the cover expands with respect to the second recess when a temperature increases and the spring allows the cover to slide down the tapered joining face.

* * * * *